US010181275B2

(12) United States Patent
Ko

(10) Patent No.: US 10,181,275 B2
(45) Date of Patent: Jan. 15, 2019

(54) DISPLAY DEVICE

(71) Applicant: LG DISPLAY CO., LTD., Seoul (KR)

(72) Inventor: Youngjo Ko, Busan (KR)

(73) Assignee: LG DISPLAY CO., LTD., Seoul (KR)

( * ) Notice: Subject to any disclaimer, the term of this patent is extended or adjusted under 35 U.S.C. 154(b) by 220 days.

(21) Appl. No.: 15/253,285

(22) Filed: Aug. 31, 2016

(65) Prior Publication Data

US 2017/0061840 A1 Mar. 2, 2017

(30) Foreign Application Priority Data

Aug. 31, 2015 (KR) ..... 10-2015-0123259

(51) Int. Cl.
*G09G 3/00* (2006.01)

(52) U.S. Cl.
CPC ..... *G09G 3/006* (2013.01); *G09G 2300/0426* (2013.01)

(58) Field of Classification Search
CPC .... G09G 2310/08; G09G 3/006; G09G 3/329; G09G 2300/0408; G09G 2300/0426
USPC ..... 324/500, 600, 76.11, 750.3, 76.49, 324/760.01, 727, 770, 760.02, 762.08, 324/762.09
See application file for complete search history.

(56) References Cited

U.S. PATENT DOCUMENTS

| | | | | |
|---|---|---|---|---|
| 9,910,537 | B2 * | 3/2018 | Yang | G06F 3/0416 |
| 9,922,585 | B2 * | 3/2018 | Kim | G09G 3/006 |
| 2007/0216618 | A1 | 9/2007 | Kim et al. | |

FOREIGN PATENT DOCUMENTS

| | | | |
|---|---|---|---|
| CN | 101571655 | A | 11/2009 |
| CN | 104217671 | A | 12/2014 |
| CN | 104464580 | A | 3/2015 |
| CN | 104616612 | A | 5/2015 |

* cited by examiner

*Primary Examiner* — Melissa Koval
*Assistant Examiner* — Trung Nguyen
(74) *Attorney, Agent, or Firm* — Birch, Stewart, Kolasch & Birch, LLP

(57) ABSTRACT

A display device including pixels, a pad area, auto-probe test wires (AP wires), and switching transistors is discussed according to an embodiment. The pixels are located in a display area of a lower substrate. The pad area is located in a non-display area of the lower substrate. The non-display area is located outside the display area in which the pixels, gate lines connected to the pixels, data lines connected to touch sensors, and sensor lines connected to the touch sensors are placed. The AP wires are located in the non-display area and connected to the display area. The switching transistors are located in the non-display area, between one side and the other side of the AP wires.

13 Claims, 11 Drawing Sheets

Before Laser trimming

Before Laser trimming (a)

(b)

(a)

(b)

(a)

(b)

(a)

(b)

DISPLAY DEVICE

CROSS-REFERENCE TO RELATED APPLICATIONS

This application claims priority from and the benefit under 35 U.S.C. § 119(a) of Korean Patent Applicatin No. 10-2015-0123259, filed on Aug. 31, 2015, which is hereby incorporated by reference for all purposes as if fully set forth herein.

BACKGROUND OF THE INVENTION

Field of the Disclosure

This document relates to a display device, and more particularly to a display device including a circular display panel and a drive part that drives the circular display panel.

Description of the Related Art

With the development of information technology, the market for displays as connecting media between users and information is growing. In line with this trend, display devices, such as an organic light emitting display (OLED), quantum dot display (QDD), liquid crystal display (LCD), and plasma display panel (PDP), are increasingly used.

For a liquid crystal display, electrophoresis display, or organic light-emitting display, a display panel is fabricated, and a testing process for the display panel is performed. In the testing process, an auto-probe test may be used to perform electrical testing (such as wiring short-circuit and lighting tests) on the whole display panel.

The auto-probe test is performed in such a way that a test needle is brought into contact with auto-probe test pads (hereinafter, "AP pads") formed on a lower substrate of the display panel and then an electrical test signal is applied. The test signal is applied to the display panel through test wires (hereinafter, "AP wires") connected to the AP pads.

The AP pads are usually formed on the outer edge of a cut-out portion of the lower substrate, which is to be cut out in the process of cutting the display panel into cells. By the way, the process of cutting the display panel into cells according to the related art may cause a short-circuit between the AP wires due to impurities produced by the cutting process, and there is a need for a solution to this problem.

SUMMARY OF THE INVENTION

The present invention provides a display device comprising pixels, a pad area, auto-probe test wires (AP wires), and switching transistors. The pixels are located in a display area of a lower substrate. The pad area is located in a non-display area of the lower substrate. The AP wires are located in the non-display area and connected to the display area. The switching transistors are located in the non-display area, between one side and the other side of the AP wires.

In another aspect, the present invention provides a display device comprising a circular display panel, and a drive part that drives the circular display panel. The circular display panel comprises pixels located in a display area of a lower substrate, a pad area located in a non-display area of the lower substrate, auto-probe test wires (AP wires) located in the non-display area and connected to the display area, and switching transistors located in the non-display area, between one side and the other side of the AP wires.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF THE EMBODIMENTS

Reference will now be made in detail to embodiments of the invention, examples of which are illustrated in the accompanying drawings.

Hereinafter, a specific exemplary embodiment of the present invention will be described in detail with reference to the attached drawings.

For a liquid crystal display, electrophoresis display, or organic light-emitting display, a display panel is fabricated, and a testing process for the display panel is performed. In the testing process, an auto-probe test may be used to perform electrical testing (such as wiring short-circuit and lighting tests) on the whole display panel.

The auto-probe test is performed in such a way that a test needle is brought into contact with auto-probe test pads (hereinafter, "AP pads") connected to the display panel and then an electrical test signal is applied.

A display device is implemented as a television receiver, set-top box, navigation system, video player, Blu-ray player, personal computer (PC), home theater, wearable device, or smartphone (mobile phone). The display panel of the display device may be, but is not limited to, a liquid crystal panel, an organic light-emitting display panel, or an electrophoretic display panel.

Hereinafter, an embodiment of the present invention will be described in detail by taking as an example a wearable device, e.g., smartwatch, implemented based on an organic light-emitting display panel, but the present invention is not limited to this example.

Figure 1:
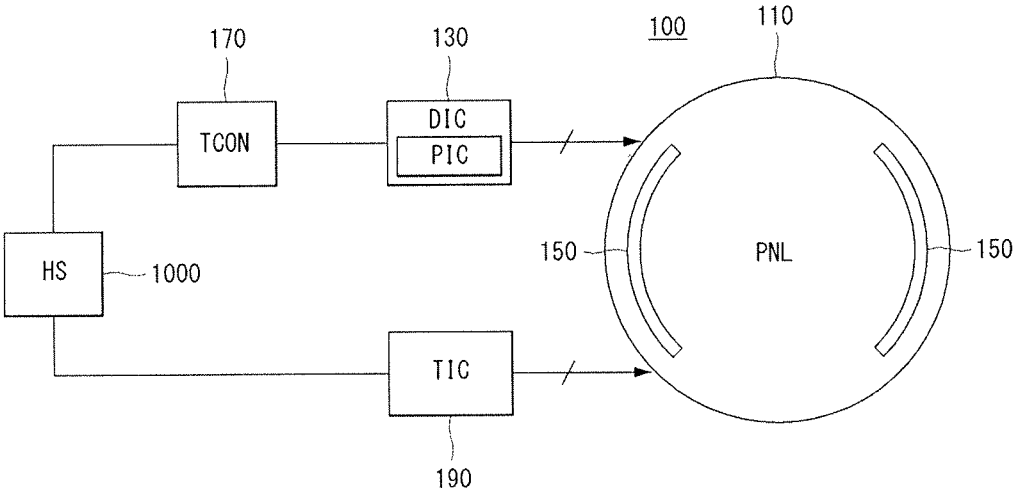
FIG. 1 is a block diagram schematically showing a display device.
Figure 2:
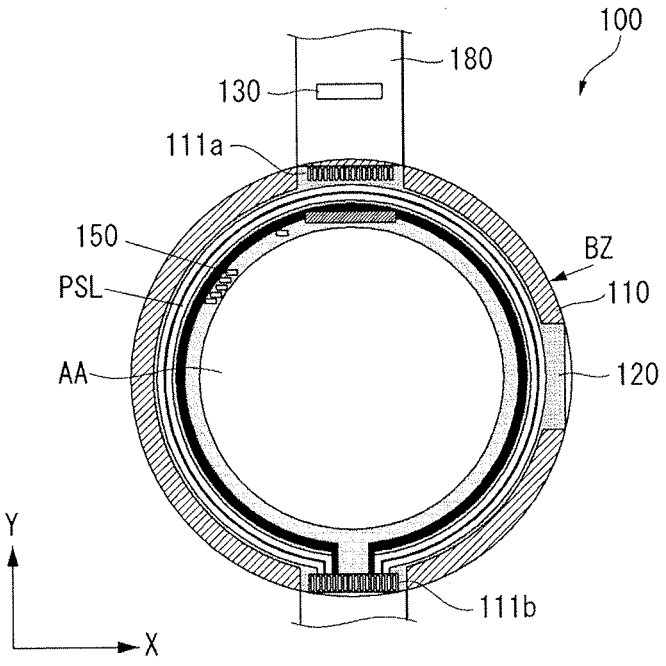
FIG. 2 is a plan view showing a display panel of a circular smartwatch.
Figure 3:
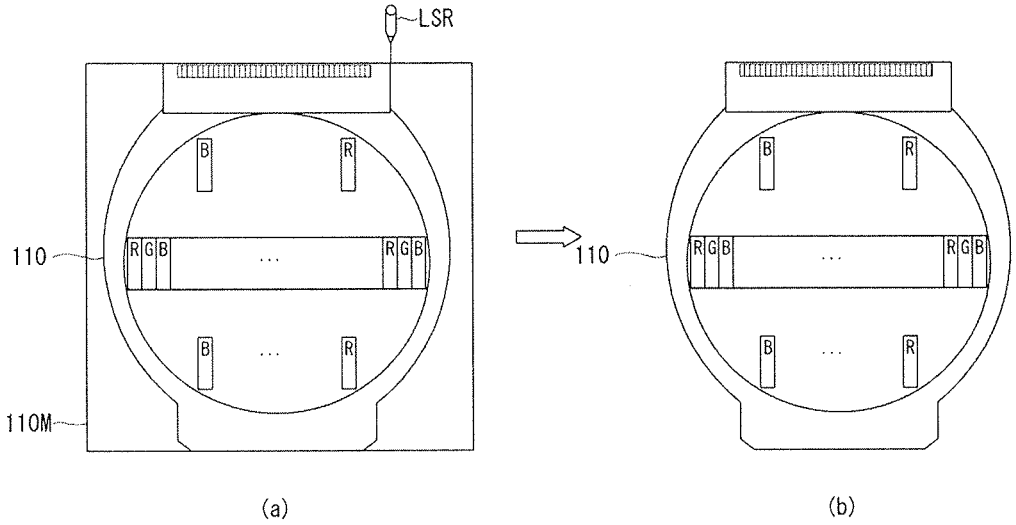
FIG. 3 is a view showing a cutting process for the display panel of the circular smartwatch.

FIG. 1 is a block diagram schematically showing a display device. FIG. 2 is a plan view showing a display panel of a circular smartwatch. FIG. 3 is a view showing a cutting process for the display panel of the circular smartwatch.

As illustrated in FIG. 1, a display device 100 comprises a data driver 130, a gate driver 150, a touch driver 190, a timing controller 170, a host system 1000, and a display panel 110.

The data driver 130 converts digital video data of an input image from the timing controller 170 to an analog positive/negative gamma compensation voltage to supply a data signal. The data driver 130 supplies the data signal to data lines connected to a plurality of pixels.

The data driver 130 comprises a source drive IC DIC. The source drive IC DIC may be mounted on a flexible circuit board such as a COF (chip on film), TCP (tape carrier package), etc. The source drive IC DIC outputs a data signal through data lines. Also, the data driver 130 comprises a power IC PIC. The power IC PIC outputs voltages required to drive the display panel 110, including a common voltage, a gate-high voltage, a gate-low voltage, and a gamma reference voltage.

The gate driver 150, along with a pixel array, is embedded in the display panel 110. The gate driver 150 embedded in the display panel 110 is formed together with a thin-film transistor process by the gate-in-panel technology. The gate driver 150 is formed around a display area AA within a non-display area BZ.

The gate driver 150 comprises a shift register. The shift register comprises a plurality of stages connected in cascade. The stages generate an output in response to the start signal, and then shift the output in accordance with the shift clock. To this end, the start signal, the shift clock, and an operating voltage, etc. are supplied to the shift register.

Although FIG. 1 illustrates the gate driver 150 embedded in the display panel 110 by way of example, the present invention is not limited thereto because the gate driver 150, like the data driver 130, may be mounted in the form of an IC on the flexible circuit board.

The timing controller 170 receives timing signals, such as a vertical synchronization signal Vsync, a horizontal synchronization signal Hsync, a data enable signal DE, and a main clock MCLK, which are input from the host system 1000, and controls the operation timings of the data driver 130 and gate driver 150.

The touch driver 190 detects position information on a finger touch by self-capacitive or mutual-capacitive touch sensors. The touch driver 190 transmits the detected position information on the finger touch to the host system 1000.

The host system 1000 comprises an SoC (system on chip) with a built-in scaler, and converts digital video data of an input image to a format suitable for displaying on the display panel 110. The host system 1000 transmits a variety of timing signals including Vsync, Hsync, DE, and MCLK, along with the digital video data of the input image, to the timing controller 170. Also, the host system 1000 executes an application associated with the touch position information input from the touch driver 190.

The display panel 110 comprises a display area AA, in which a plurality of pixels, data lines connected to a plurality of touch sensors and the pixels, gate lines connected to the pixels, power supply lines for supplying gate driving power to the gate driver, and sensor lines connected to the touch sensors are placed, and a non-display area (or bezel area) BZ located on the outside of the display area AA.

As illustrated in FIG. 2, the display panel 110 is formed in circular shape, for example. As well as the circular shape, the display panel 110 may be formed in a variety of shapes such as square, rectangle, polygon, and ellipse, etc.

The display panel 110 comprises two or more pad portions 111*a* and 111*b* separated vertically within the non-display area BZ. The pad portions 111*a* and 111*b* are placed on the outermost edges of the non-display area BZ defined on a lower substrate of the display panel 110.

The pad portions 111*a* and 111*b* comprise a plurality of data pads for passing a data signal, a plurality of gate driving power supply pads for passing a gate driving power, a plurality of pixel power supply pads for passing a power to the pixels, and a plurality of sensor pads for passing a sensor signal.

The pad portions 111*a* and 111*b* comprise a first pad portion 111*a* that electrically connects a first group of lines, among the data lines, gate lines, sensor lines, and power supply lines PSL, to a first drive circuit portion, and a second pad portion 111*b* that electrically connects a second group of lines, among the data lines, gate lines, sensor lines, and power supply lines PSL, to a second drive circuit portion.

Although the first and second drive circuit portions perform substantially the same function and operation, they may be integrated into a single drive circuit or physically or positionally divided (separated), depending on the structure of the display panel 110. For ease of explanation, the following description will be given of the data driver 130 mounted on the flexible circuit board 180. The flexible circuit board 180 is electrically connected to the first and second pad portions 111*a* and 111*b* by an anisotropic conductive film ACF, etc.

The first pad portion 111*a* is placed on the upper edge of the lower substrate of the display panel 110. The second pad portion 111*b* is placed on the lower edge of the lower substrate of the display panel 110 that faces the first pad portion 111*a*. A touch pad 120 is placed on one side of the non-display area BZ located between the first pad portion 111*a* and second pad portion 111*b*. In this way, the touch pad 120 may not overlap the first pad portion 111*a* and the second pad portion 111*b*.

As illustrated in (a) of FIG. 3, the above-described display panel 110, divided into cells, is formed on a mother substrate 110M. The mother substrate 110M may comprise a lower substrate where a device is formed, and an upper substrate that encapsulates the device formed on the lower substrate.

As illustrated in (b) of FIG. 3, the display panel 110 formed on the mother substrate 110M becomes a single display panel 110 only after undergoing a process of cutting it into cells. The cutting process may be done by laser trimming using a laser LSR.

However, the process of cutting the display panel into cells may cause a short-circuit between AP wires due to impurities produced by the cutting process. The impurities may be called ash, particles, by-products, etc. and vary depending on the structure located at or around a cut-out portion or depending on the environment.

Now, an exemplary embodiment that can address problems in test examples and solve or eliminate them will be described.

While the following description will be given on the assumption that the process of cutting the display panel into cells is performed by laser trimming using a laser, the present invention is not limited thereto. Also, for the understanding of the present invention, the following description will be given on the assumption that the cutting process is performed while the flexible circuit board 180 with the data driver 130 mounted on it is attached, but instead, the flexible circuit board 180 may be attached after the cutting process.

Figure 4:
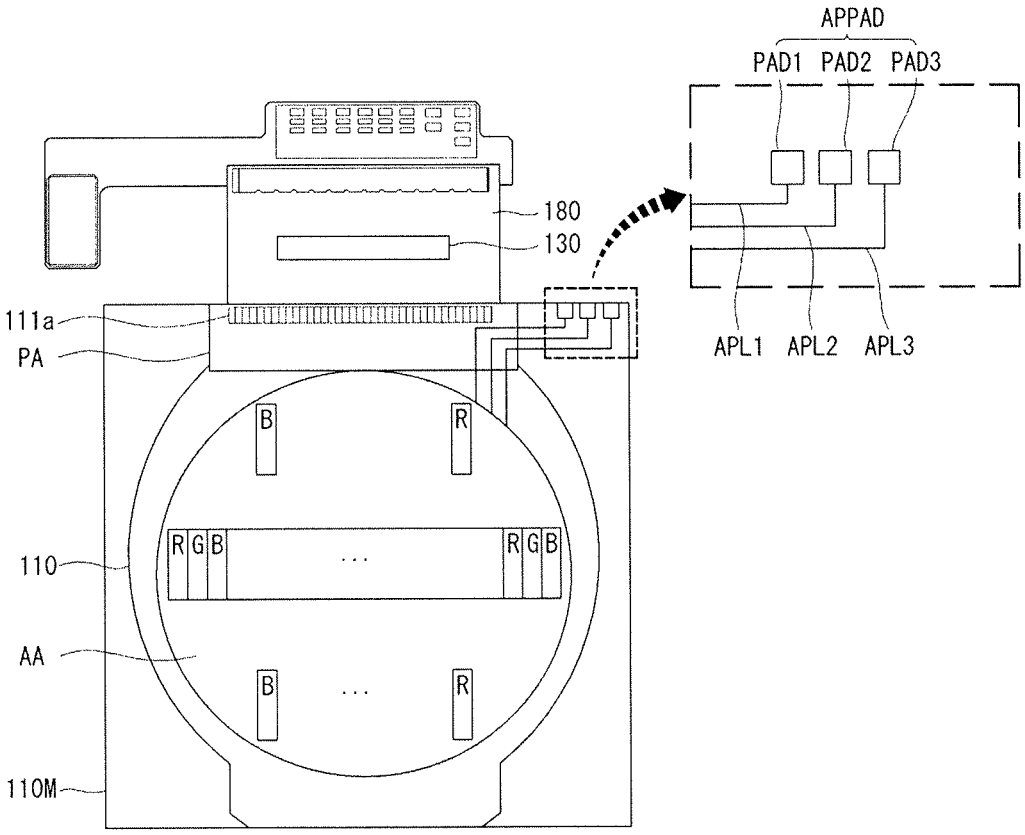
FIGS. 4 and 5 are views illustrating a process of cutting a display panel into cells according to a test example.
Figure 5:
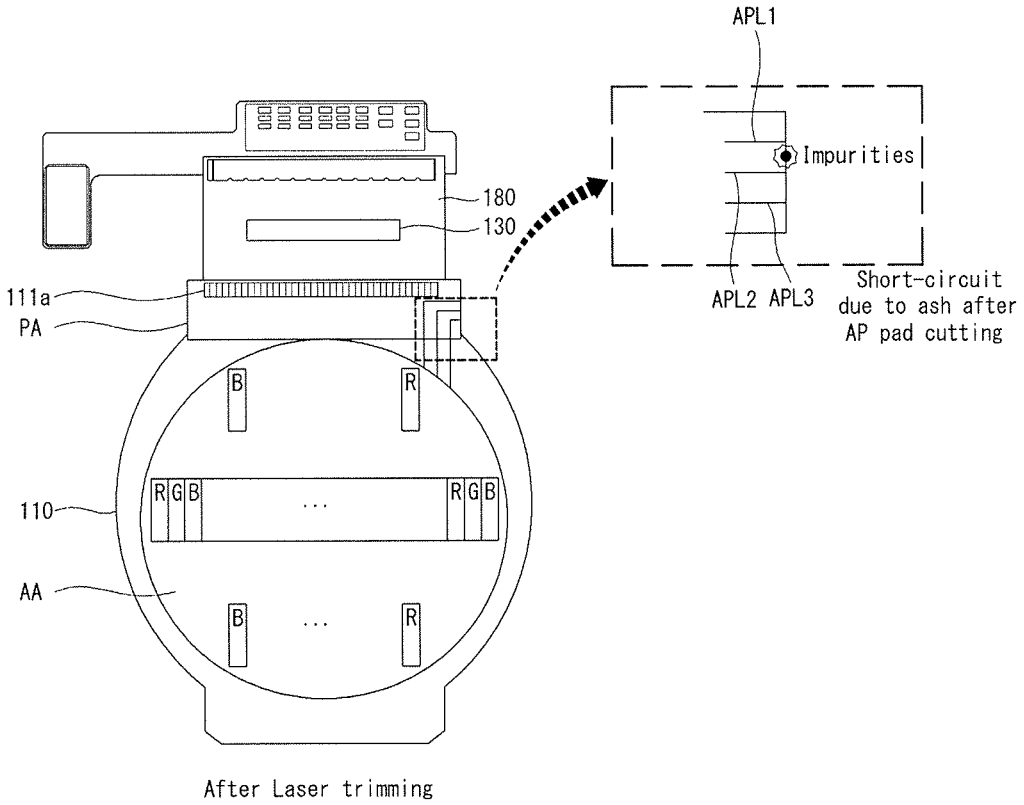
Figure 6:
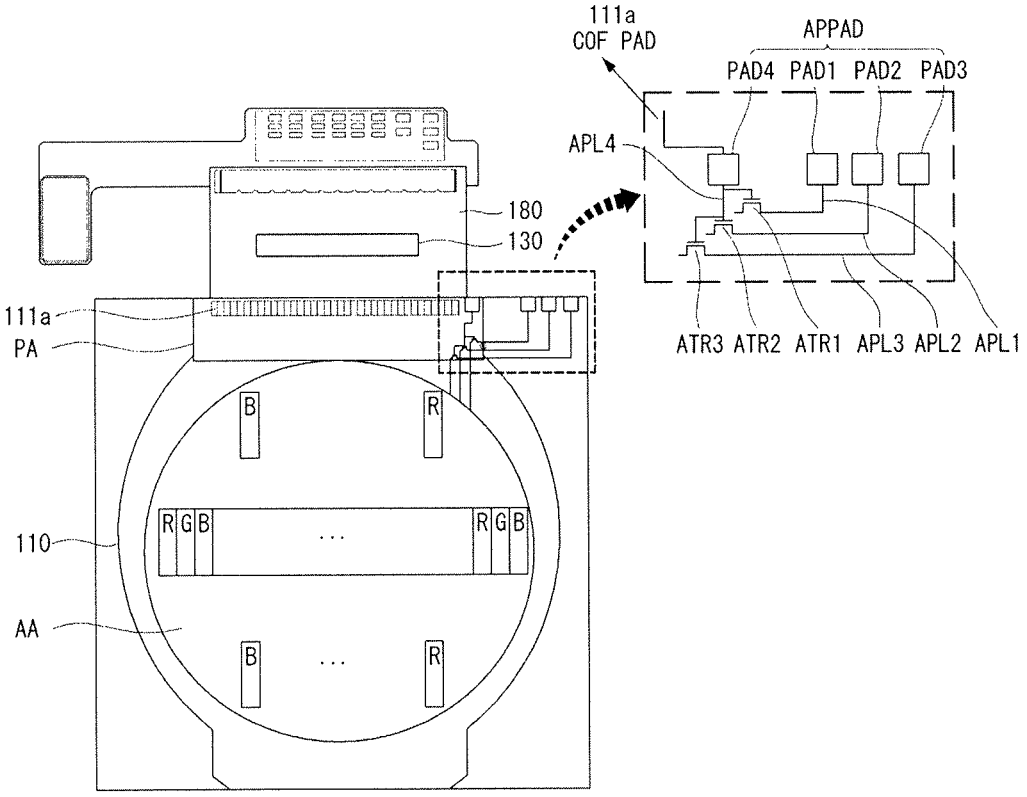
FIGS. 6 and 7 are views showing a process of cutting a display panel into cells according to an exemplary embodiment of the present invention.
Figure 7:
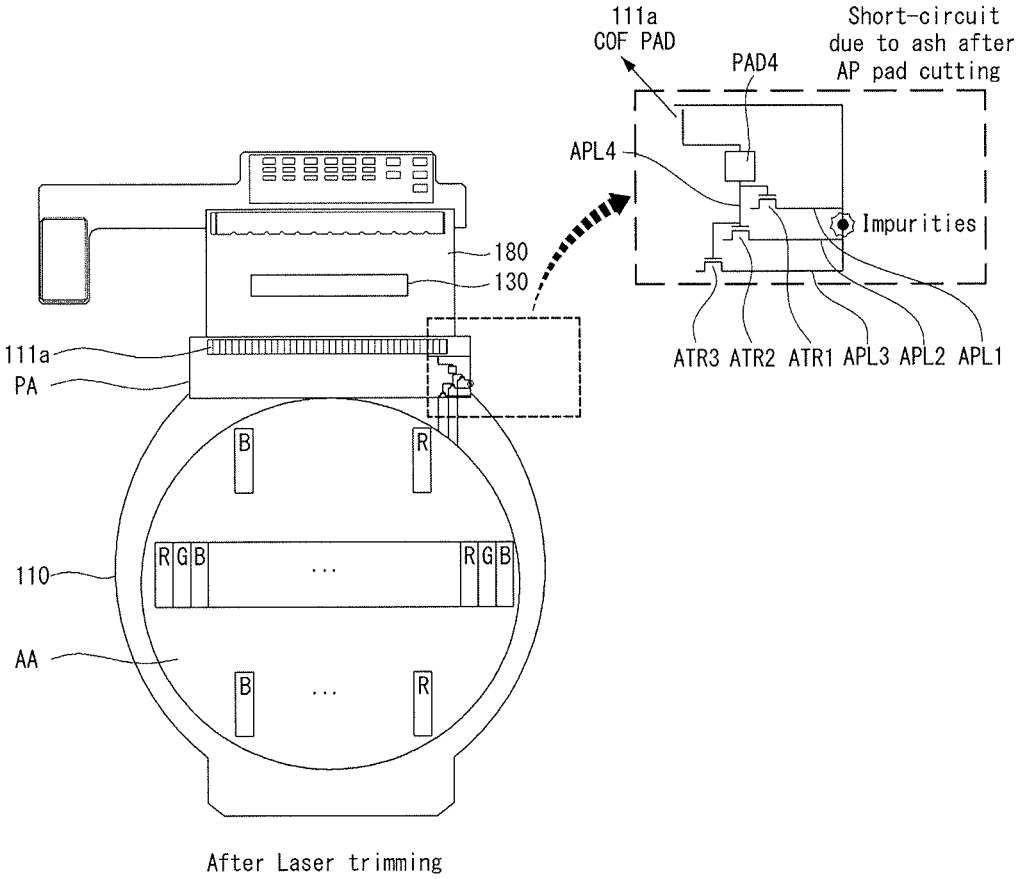

FIGS. 4 and 5 are views illustrating a process of cutting a display panel into cells according to a test example. FIGS. 6 and 7 are views showing a process of cutting a display panel into cells according to an exemplary embodiment of the present invention.

Experimental Example: Before the Cutting Process—

As illustrated in FIG. 4, a display panel 110, divided into cells, is formed on a mother substrate 110M. The display panel 110 comprises a display area AA with red, green, and blue subpixels RGB and a pad area PA with a pad portion 111*a* where a flexible circuit board 180 with a data driver 130 mounted on it is attached. The pad area PA is located in the non-display area BZ.

AP pads APPAD are located on one side of the mother substrate 110M. The AP pads APPAD comprise first to third AP pads PAD1 to PAD3. The first to third AP pads PAD1 to PAD3 are electrically connected to the display panel 110 through first to third AP wires APL1 to APL3. The first to third AP wires APL1 to APL3 are arranged on one side of the mother substrate 110M so that they pass through the pad area PA of the lower substrate of the display panel 110 and go into the display area AA.

After forming cells in the above configuration, a testing process for the display panel 110 is performed. In the testing process, an auto-probe test may be used to perform electrical testing (such as wiring short-circuit and lighting tests) on the whole display panel 110.

The auto-probe test is performed in such a way that a test needle is brought into contact with the first to third AP pads PAD1 to PAD3 connected to the display panel 110 and then an electrical test signal is applied.

Experimental Example: After the Cutting Process—

As illustrated in FIG. 5, the display panel 110 is separated from the mother substrate after the process of cutting the display panel 110 into cells. After the process of cutting the display panel 110 into cells, it was observed that the display panel 110 had a short-circuit between the AP wires APL1 to APL3 due to impurities—which may be called ash, particles, by-products, etc. and vary depending on the structure located at or around a cut-out portion or depending on the environment—produced by the cutting process. The short-circuit between the AP wires APL1 to APL3 occurred most often due to ash produced by the cutting process.

Therefore, it can be inferred that the experimental example cannot solve the short-circuit problem that occurs after the cutting process. As described above, the experimental example requires additional processes such as a manual operation for the recovery of a short-circuited region, which results in low workability and low production yield.

Embodiment: Before the Cutting Process—

As illustrated in FIG. 6, in the embodiment, switching transistors ATR1 to ATR3 serving to prevent the short-circuit are placed on paths between AP wires APL1 to APL3, in order to solve the short-circuit problem between the AP wires APL1 to APL3. The switching transistors ATR1 to ATR3 are placed on the lower substrate of the display panel 110.

First electrodes (e.g., source electrodes) of the switching transistors ATR1 to ATR3 are respectively connected to the first to third AP wires APL1 to APL3 on one side connected to the display area AA of the display panel 110, and their second electrodes (e.g., drain electrodes) are respectively connected to the first to third AP wires APL1 to APL3 on the other side connected to the first to third AP pads PAD1 to PAD3.

Gate electrodes of the switching transistors ATR1 to ATR3 are joined together and connected to a fourth AP pad PAD4. The gate electrodes of the switching transistors ATR1 to ATR3 may be joined (connected) together by a fourth AP wire APL4, for example, and then connected to the fourth AP pad PAD4, but the present invention is not limited thereto.

After forming cells in the above configuration, a testing process for the display panel 110 is performed. In the testing process, an auto-probe test may be used to perform electrical testing (such as wiring short-circuit and lighting tests) on the whole display panel 110.

The auto-probe test is performed in such a way that a test needle is brought into contact with the first to fourth AP pads PAD1 to PAD4 connected to the display panel 110 and then an electrical test signal is applied.

It should be noted that, unlike the test example, the test signal is applied after applying a signal to the fourth AP pad PAD4 and turning on the switching transistors ATR1 to ATR3 in the embodiment. This is because the test signal applied to the first to third AP pads PAD1 to PAD3 is sent to the display area AA of the lower substrate of the display panel 110 only after the switching transistors ATR1 to ATR3 are turned on.

Embodiment: After the Cutting Process—

As illustrated in FIG. 7, the display panel 110 is separated from the mother substrate after the process of cutting the display panel 110 into cells. After the process of cutting the display panel 110 into cells, it was observed that, in the embodiment, a short-circuit between the AP wires APL1 to APL3 due to impurities generated by the cutting process did not affect the display panel 110. This is because the switching transistors ATR1 to ATR3 turn on only when the auto-probe test is performed.

With the above configuration according to the embodiment, a path for a test signal fed through the AP wires APL1 to APL3 is established to send it into the display area AA of the display panel 110 only when the auto-probe test is performed. Then, the path for test signal transmission is cut off after completion of the auto-probe test (including the after-cutting process).

To this end, the gate electrodes of the switching transistors ATR1 to ATR3 and the fourth AP pad PAD4 are located in the pad area PA, and connected to some pads of the pad portion 111*a* that draw power to a high-voltage power line or low-voltage power line. The switching transistors ATR1 to ATR3 remain turned off by the power provided through the high-voltage power line or low-voltage power line.

As such, the switching transistors ATR1 to ATR3 turn off after completion of the auto-probe test (including the after-cutting process), and hence the test signal is not provided into the display area AA of the display panel 110.

Therefore, the configuration according to the embodiment can prevent an operational error or electrical problem on the display panel 110 even if a short-circuit occurs between the AP wires APL1 to APL3 due to impurities after the cutting process. Also, the configuration according to the embodiment can omit an unnecessary process such as a manual operation for the recovery of a short-circuited region, which can contribute to improving workability and production yield.

Hereinafter, variations of the locations of AP pads, variations of the locations of switching transistors, and different types of switching transistors according to other exemplary embodiments will be described.

Figure 8:
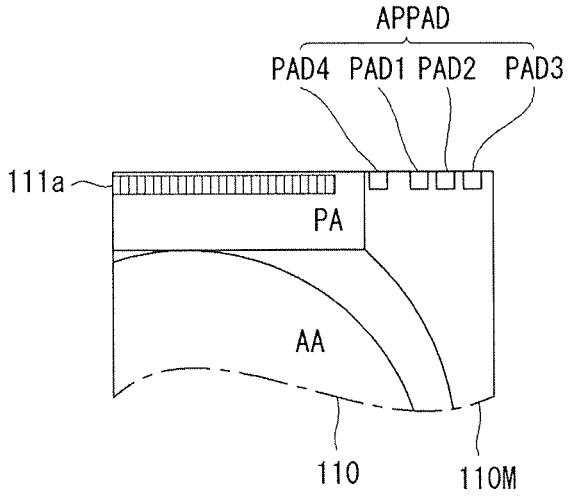
FIGS. 8 and 9 are views illustrating variations of the locations of AP pads according to another exemplary embodiment of the present invention.
Figure 8:
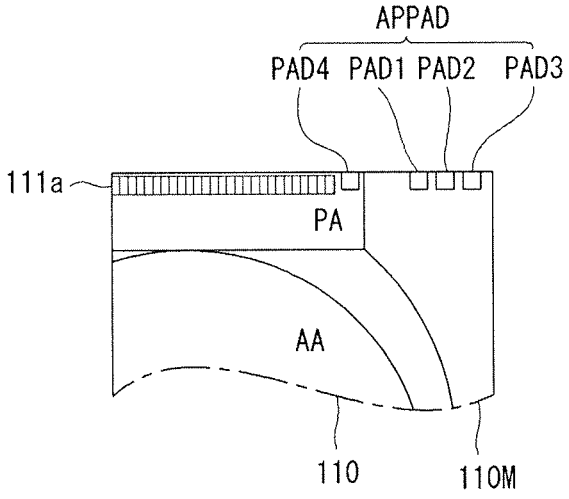
Figure 9:
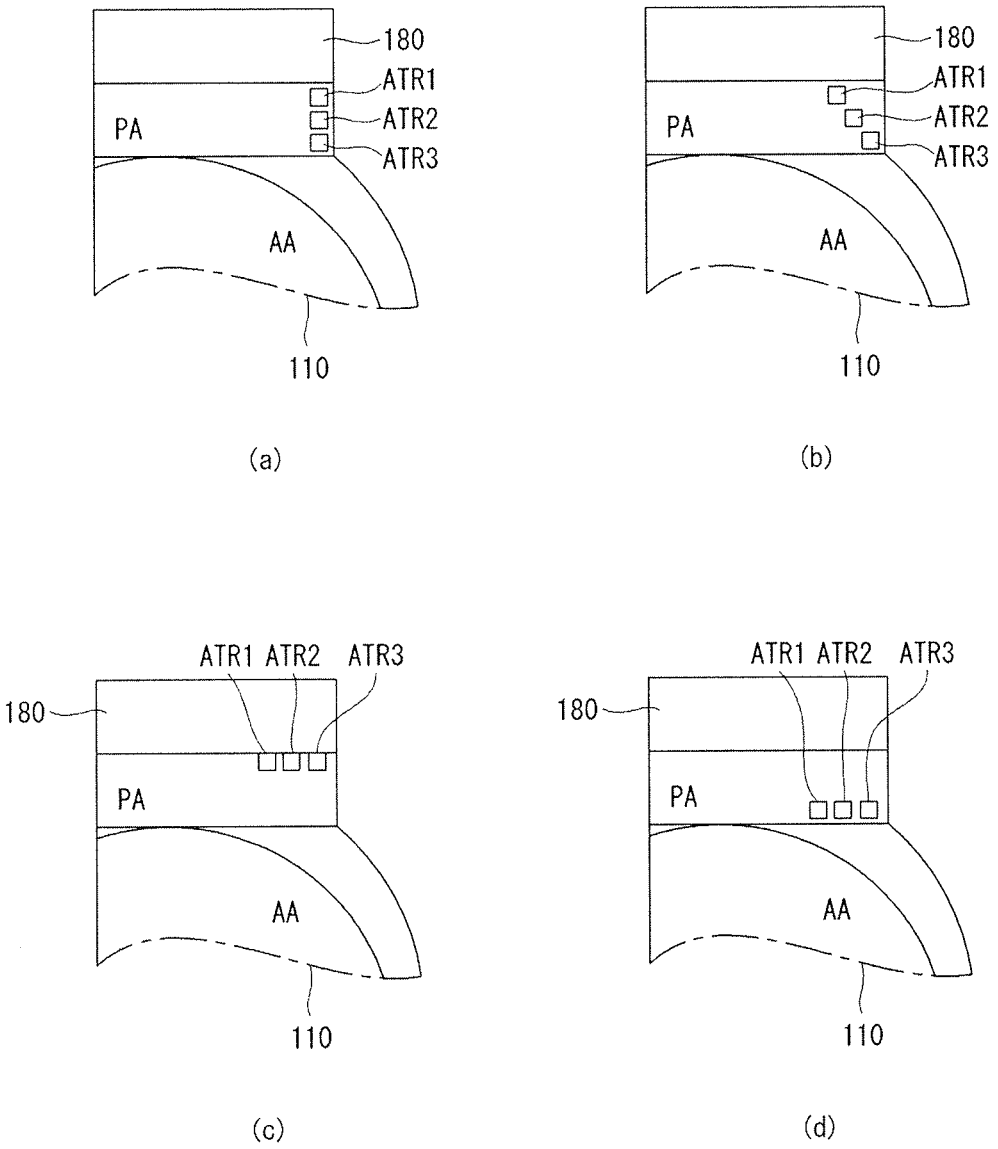
Figure 10:
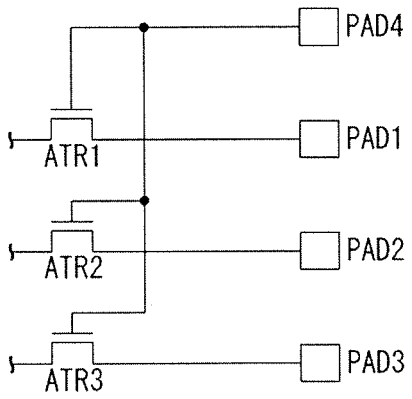
FIG. 10 is a view illustrating different types of switching transistors according to another exemplary embodiment of the present invention.
Figure 10:
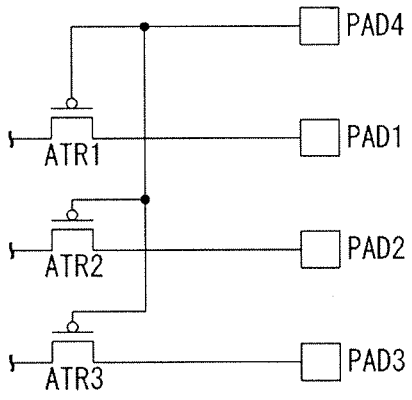
Figure 11:
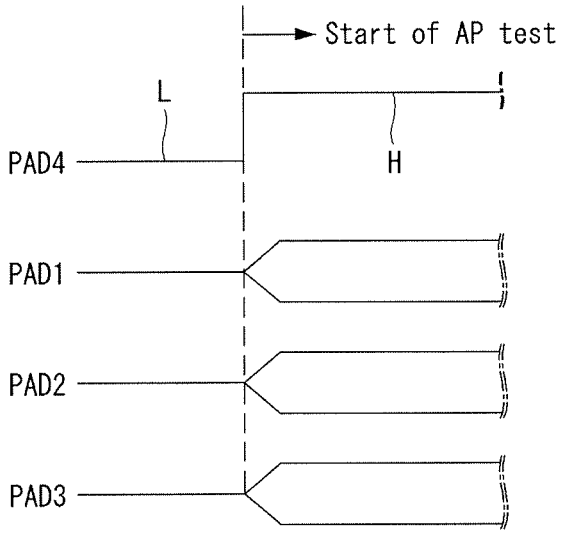
FIG. 11 is a view illustrating different test signals corresponding to the different types of switching transistors according to another exemplary embodiment of the present invention.
Figure 11:
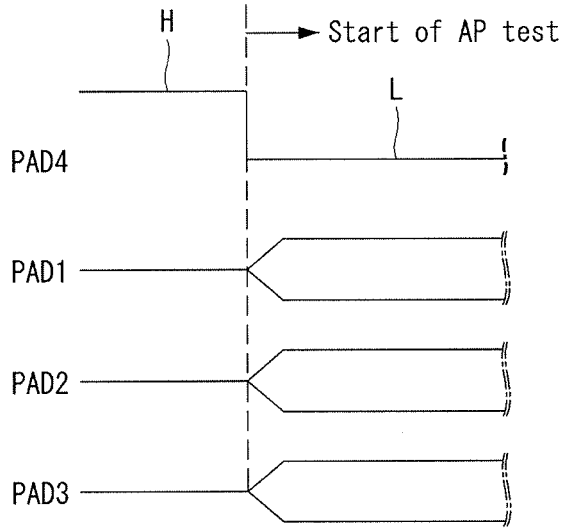
Figure 12:
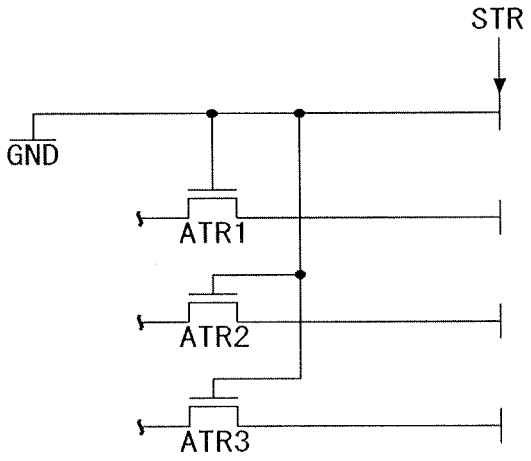
FIG. 12 is a view illustrating different signal line coupling structures corresponding to the different types of switching transistors.
Figure 12:
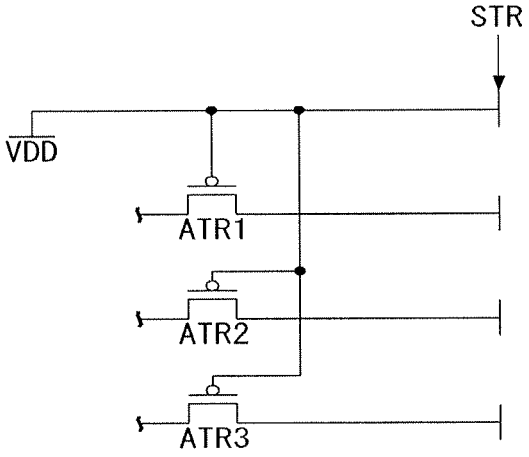

FIGS. 8 and 9 are views illustrating variations of the locations of AP pads according to another exemplary embodiment of the present invention. FIG. 10 is a view illustrating different types of switching transistors according to another exemplary embodiment of the present invention. FIG. 11 is a view illustrating different test signals corresponding to the different types of switching transistors according to another exemplary embodiment of the present invention. FIG. 12 is a view illustrating different signal line coupling structures corresponding to the different types of switching transistors.

[Variations of the Locations of AP Pads According to Another Embodiment]

As illustrated in (a) of FIG. 8, the first to fourth AP pads PAD1 to PAD4 may be formed on the mother substrate 110M adjacent to the pad area PA. Once the first to fourth AP pads PAD1 to PAD4 are formed on the mother substrate 110M, then they are all removed by the cutting process. Accordingly, the first to fourth AP pads PAD1 to PAD4 do not exist on the completed display panel 110.

As illustrated in (b) of FIG. 8, the first to third AP pads PAD1 to PAD3 may be formed on the mother substrate 110M adjacent to the pad area PA, and the fourth AP pad PAD4 may be formed in the pad area PA adjacent to the outer side of the pad portion 111*a*.

Once the first to third AP pads PAD1 to PAD3 are formed on the mother substrate 110M and the fourth AP pad is formed in the pad area PA, then the first to third AP pads PAD1 to PAD3 are removed, but the fourth AP pad PAD4 is left. Accordingly, the first to third AP pads PAD1 to PAD3 do not exist on the completed display panel 110.

[Variations of the Locations of Switching Transistors According to Another Embodiment]

As illustrated in (a) of FIG. 9, the first to third switching transistors ATR1 to ATR3 are vertically placed in the pad area PA of the lower substrate. The first to third switching transistors ATR1 to ATR3 may be vertically placed along the outermost boundary of the pad area PA of the lower substrate PA.

The first to third switching transistors ATR1 to ATR3 may be placed in the way described above, if the remaining space in the pad area PA of the lower substrate of the display panel 110 is narrow.

As illustrated in (b) of FIG. 9, the first to third switching transistors ATR1 to ATR3 are obliquely (diagonally) placed in the pad area PA of the lower substrate. The first to third switching transistors ATR1 to ATR3 may be arranged in a stepwise fashion along the outermost boundary of the pad area PA of the lower substrate.

By forming the pad area PA on the lower substrate of the display panel 110 in a stepwise fashion (or in a nearly circular shape) along the outermost boundary, the first to third switching transistors ATR1 to ATR3 may be placed as described above.

As illustrated in (c) of FIG. 9, the first to third switching transistors ATR1 to ATR3 are horizontally placed in the pad area PA of the lower substrate. The first to third switching transistors ATR1 to ATR3 may be horizontally placed in the pad area PA adjacent to the flexible circuit board 180.

By placing the first to third switching transistors ATR1 to ATR3 in this way, a test needle may be easily brought into contact with them. Moreover, when there is a need for an additional test after the display panel 110 is integrated into a module, the first to third switching transistors ATR1 to ATR3 may be placed as described above.

As illustrated in (d) of FIG. 9, the first to third switching transistors ATR1 to ATR3 are horizontally placed in the pad area PA of the lower substrate. The first to third switching transistors ATR1 to ATR3 may be horizontally placed in the pad area PA adjacent to the display area AA.

By placing the first to third switching transistors ATR1 to ATR3 in this way, a test needle may be easily brought into contact with them. Moreover, when there is a need for an additional test after the display panel 110 is integrated into a module, the first to third switching transistors ATR1 to ATR3 may be placed as described above.

[Different Types of Switching Transistors According to Another Embodiment]

As illustrated in (a) of FIG. 10, (a) of FIG. 11, and (a) of FIG. 12, the first to third switching transistors ATR1 to ATR3 may consist of N-type transistors. If the first to third switching transistors ATR1 to ATR3 consist of N-type transistors, a logic-high voltage H is supplied to the fourth AP pad PAD4.

The logic-high voltage H, which is the fourth test signal, is supplied from a testing device at the start of a testing process. Also, first to third test signals to be fed to the first to third AP pads PAD1 to PAD3 are supplied from the testing device.

As the first to third switching transistors ATR1 to ATR3 consist of N-type transistors, all of them turn on simultaneously when supplied with the logic-high voltage H and turn off simultaneously when supplied with a logic-low voltage L.

As explained above, the first to third switching transistors ATR1 to ATR3 may remain turned on only during the testing process and remain turned off (or floating) upon completion of the testing process.

To keep the first to third switching transistors ATR1 to ATR3 consisting of N-type transistors turned off, their gate electrodes may be coupled to a low-level voltage line (e.g., GND) that exists on the display panel.

As illustrated in (b) of FIG. 10, (b) of FIG. 11, and (b) of FIG. 12, the first to third switching transistors ATR1 to ATR3 may consist of P-type transistors. If the first to third switching transistors ATR1 to ATR3 consist of P-type transistors, a logic-low voltage L is supplied to the fourth AP pad PAD4.

The logic-low voltage L, which is the fourth test signal, is supplied from a testing device at the start of a testing process (AP test). Also, first to third test signals to be fed to the first to third AP pads PAD1 to PAD3 are supplied from the testing device.

As the first to third switching transistors ATR1 to ATR3 consist of P-type transistors, all of them turn on simultaneously when supplied with the logic-low voltage L and turn off simultaneously when supplied with a logic-high voltage H.

As explained above, the first to third switching transistors ATR1 to ATR3 may remain turned on only during the testing process and remain turned off (or floating) upon completion of the testing process.

To keep the first to third switching transistors ATR1 to ATR3 consisting of P-type transistors turned off, their gate electrodes may be coupled to a high-level voltage line (e.g., VDD) that exists on the display panel.

According to the above-described embodiments, the fourth AP pad PAD4 is connected to the pads on the flexible circuit board 180 attached to the pad area PA. The fourth AP pad PAD4 may be connected to pads that draw power from the low-level voltage line (e.g., GND) or high-level voltage line (e.g., VDD), especially depending on the type (N-type or P-type) of the switching transistors ATR1 to ATR3.

By coupling the fourth AP pad PAD4 as described above, the display panel 110 is integrated into a module after the testing process, and if the display panel 110 operates normally, the switching transistors ATR1 to ATR3 remain turned off.

STR of FIG. 12 denotes the far ends of AP wires remaining on the outer edge of the display panel after the cutting process. The far ends of the AP wires are broken (open-circuited), corresponding to a cut-out portion produced by the cutting process.

Therefore, the far ends of the AP wires connected to the second electrodes of the first to third switching transistors ATR1 to ATR3 are electrically coupled to nothing at all, so that they end up floating electrically.

Meanwhile, the display panel needs to undergo additional processes before it is made into a final product. By the way, static electricity may enter the display panel during these additional processes, during a process of installing a plastic structure on the display panel, or in a natural state.

The far ends STR of the AP wires may act as a path through which static electricity, etc. enters. If static electricity, overcurrent, or a different voltage enters through the AP wires, the pixels existing in the display area AA of the lower substrate of the display panel 110 may be damaged.

Accordingly, rather than keeping the switching transistors ATR1 to ATR3 electrically floating, the gate electrodes may be connected to a particular voltage and remain completely turned off as described above.

In other words, problems with external static electricity, overcurrent, or a different voltage can be prevented or avoided since the switching transistors ATR1 to ATR3 according to the present invention are connected to a particular voltage and remain completely turned off.

The present invention is excellent in avoiding circuit damage caused by a short-circuit between AP wires or by static electricity, in the manufacture of a small-sized circular display panel that is implemented based on a small-sized display such as a wearable device or that is cut by a laser. It is needless to say that the present invention can be applied in the manufacture of medium- or large-sized displays as well as small-sized displays.

As seen from above, the present invention can avoid circuit damage caused by a short-circuit between AP wires or by static electricity, in the manufacture of a display panel. Moreover, the present invention can prevent an operational error or electrical problem on the display panel even if a short-circuit occurs between the AP wires. Additionally, the present invention may omit additional processes such as a manual operation for the recovery of a short-circuited region, which can contribute to improving workability and production yield.

What is claimed is:

1. A display device comprising:

pixels located in a display area of a lower substrate;

a pad area located in a non-display area of the lower substrate;

auto-probe test wires (AP wires) located in the non-display area and connected to the display area; and switching transistors located in the non-display area, and between one side and the other side of the AP wires, wherein the AP wires comprise first to third AP wires, the switching transistors comprise first to third switching transistors, one side of the first to third AP wires is connected to first electrodes of the first to third switching transistors respectively, and the other side of the first to third AP wires is connected to second electrodes of the first to third switching transistors respectively.

2. The display device of claim 1, further comprising auto-probe test pads (AP pads), wherein the AP pads are connected to gate electrodes of the switching transistors.

3. The display device of claim 2, wherein the AP pads are located in the non-display area.

4. The display device of claim 2, wherein the gate electrodes of the switching transistors are connected to a pad portion located in the pad area.

5. The display device of claim 1, wherein the switching transistors are placed adjacent to the pad area.

6. The display device of claim 1, wherein the switching transistors are placed in a vertical, horizontal, or diagonal direction.

7. The display device of claim 2, wherein the gate electrodes of the switching transistors are commonly connected to a low-level voltage line or high-level voltage line located on the lower substrate.

8. The display device of claim 1, wherein the other side of the first to third AP wires is open-circuited.

9. The display device of claim 1, wherein the first to third switching transistors are N-type transistors or P-type transistors.

10. A display device comprising:

a circular display panel; and a drive part that drives the circular display panel, wherein the circular display panel includes:

pixels located in a display area of a lower substrate;

a pad area located in a non-display area of the lower substrate;

auto-probe test wires (AP wires) located in the non-display area and connected to the display area; and switching transistors located in the non-display area, and between one side and the other side of the AP wires, wherein the AP wires comprise first to third AP wires, the switching transistors comprise first to third switching transistors, one side of the first to third AP wires is connected to first electrodes of the first to third switching transistors respectively, and the other side of the first to third AP wires is connected to second electrodes of the first to third switching transistors respectively.

11. The display device of claim 10, wherein the switching transistors are placed in a vertical, horizontal, or diagonal direction.

12. The display device of claim 10, wherein gate electrodes of the switching transistors are commonly connected to a low-level voltage line or high-level voltage line located on the lower substrate.

13. The display device of claim 10, wherein the other side of the first to third AP wires is open-circuited.

* * * * *